US008500256B2

(12) United States Patent
Nitta et al.

(10) Patent No.: US 8,500,256 B2
(45) Date of Patent: Aug. 6, 2013

(54) INKJET HEAD DEVICE AND METHOD OF CONTROLLING INKJET HEAD

(75) Inventors: Noboru Nitta, Shizuoka (JP); Hideyuki Akaba, Kanagawa (JP)

(73) Assignees: Kabushiki Kaisha Toshiba, Tokyo (JP); Toshiba TEC Kabushiki Kaisha, Tokyo (JP)

( * ) Notice: Subject to any disclaimer, the term of this patent is extended or adjusted under 35 U.S.C. 154(b) by 336 days.

(21) Appl. No.: 13/038,262

(22) Filed: Mar. 1, 2011

(65) Prior Publication Data

US 2012/0062627 A1 Mar. 15, 2012

(30) Foreign Application Priority Data

Sep. 14, 2010 (JP) ..... 2010-205633

(51) Int. Cl.
*B41J 2/175* (2006.01)

(52) U.S. Cl.
USPC ..... 347/85

(58) Field of Classification Search
CPC ..... B41J 2/175; B41J 2/17509
USPC ..... 347/9, 19, 84, 85
See application file for complete search history.

(56) References Cited

U.S. PATENT DOCUMENTS

| | | | | |
|---|---|---|---|---|
| 4,410,900 | A | 10/1983 | Terasawa et al. | |
| 6,783,215 | B2 * | 8/2004 | Yoshida et al. | 347/85 |
| 8,109,613 | B2 * | 2/2012 | Nitta et al. | 347/59 |

FOREIGN PATENT DOCUMENTS

| | | |
|---|---|---|
| JP | 56060256 | 5/1981 |
| JP | 2002-234175 | 8/2002 |
| JP | 2005-096272 A | 4/2005 |
| JP | 2009-285846 | 12/2009 |

OTHER PUBLICATIONS

Japanese Application No. 2010-205633 Office Action (Jan. 8, 2013) (English translation attached).

* cited by examiner

*Primary Examiner* — An Do
(74) *Attorney, Agent, or Firm* — Patterson & Sheridan, L.L.P.

(57) ABSTRACT

According to one embodiment, an inkjet device includes: an ink circulating device configured to communicate with an inkjet head to form an ink circulating system; an arithmetic unit configured to calculate, on the basis of pressure detected from the ink circulating system, pressure in an ink discharge port section according to an arithmetic expression set in advance; a pressure determining unit configured to determine, with proper nozzle pressure in the ink discharge port not discharging ink set as a reference value, whether a value calculated by the arithmetic unit is positive pressure or negative pressure with respect to the reference value; and a negative pressure regulator configured to communicate with the ink circulating system and perform, if the pressure determining unit determines that the value is the positive pressure, an ink reducing operation in the ink circulating system and increase a negative pressure value on the ink discharge port. The pressure determining unit changes the reference value to a negative pressure side.

20 Claims, 3 Drawing Sheets

INKJET HEAD DEVICE AND METHOD OF CONTROLLING INKJET HEAD

CROSS-REFERENCE TO RELATED APPLICATION

This application is based upon and claims the benefit of priority from the prior Japanese Patent Application No. 2010-205633 filed on Sep. 14, 2010, the entire contents of which are incorporated herein by reference.

FIELD

Embodiments described herein relate generally to an inkjet device including an inkjet head provided with a driving electrode in a channel for circulating ink and configured to apply an electric field to the driving electrode to thereby discharge the ink from an ink discharge port and a method of controlling the inkjet head.

BACKGROUND

In the past, in an inkjet head provided with a nozzle for ink at a distal end of an ink channel and configured to discharge ink droplets from the nozzle and form an image, the ink dries in a slim nozzle if the ink is not discharged for a while. In other words, in some cases, clogging of the nozzle and a discharge failure of the ink occur because thickened ink is held up in the nozzle. Therefore, there are various drying preventing methods. As a representative method, there is a method of covering the nozzle with a nozzle cap to block the nozzle from the outside air when an ink jet reaches a nonprinting area. There is also a method of sucking the ink in the nozzle with sucking means provided on the outside after covering the nozzle with a nozzle cap in which an ink absorbing pad is provided.

Further, as a method of preventing the clogging of the ink and the discharge failure of the ink, there is disclosed a technique for performing, during a period of movement of a carriage performed prior to a printing operation, an idle driving operation for causing microvibration of ink meniscuses of nozzles with pressure generating means.

However, in the method of simply covering the nozzle of the inkjet head with the nozzle cap, unless air tightness of the nozzle cap is considerably kept, the drying of the nozzle cannot be prevented. Therefore, the method is insufficient as a nozzle drying preventing method. In the method of sucking the ink in the nozzle to the outside with the sucking means, it is necessary to powerfully suck the ink hardened by drying in the nozzle. Therefore, consumption of the ink increases.

As explained above, in the inkjet head, the clogging of the nozzle occurs because of an increase in ink viscosity in the nozzle if an idle period of printing is long. Even if the increase in the ink viscosity does not result in the clogging, because of the length of the printing idle time, discharge of ink droplets is not normally performed and image quality is deteriorated.

As measures against this problem, there is known a method of discharging thickened ink in the nozzle by performing preliminary discharge unrelated to printing. However, in this method, excess consumption of the ink due to the preliminary discharge increases.

In the method of reducing ink thickening in the nozzle by performing the idle driving for causing microvibration of meniscuses, since the thickened ink is not discharged to the outside, clogging of the nozzle cannot be sufficiently removed depending on transition of a state in which the inkjet head is used. This idle driving processing is performed only in an accelerating and decelerating region, which is a period in which the inkjet head is moved from a home position to a printing position, and idle driving processing corresponding to a printing state is not performed. Therefore, an interval of the preliminary discharge cannot be set longer than the period.

DETAILED DESCRIPTION

In general, according to one embodiment, an inkjet device includes: an ink circulating device configured to communicate with an inkjet head to form an ink circulating system; an arithmetic unit configured to calculate, on the basis of pressure detected from the ink circulating system, pressure in an ink discharge port section according to an arithmetic expression set in advance; a pressure determining unit configured to determine, with proper nozzle pressure in an ink discharge port not discharging ink set as a reference value, whether a value calculated by the arithmetic unit is positive pressure or negative pressure with respect to the reference value; and a negative pressure regulator configured to communicate with the ink circulating system and perform, if the pressure determining unit determines that the value is the positive pressure, an ink reducing operation in the ink circulating system and increase a negative pressure value on the ink discharge port. The pressure determining unit changes the reference value to a negative pressure side.

Various embodiments will be described hereinafter with reference to the accompanying drawings.

Figure 1:
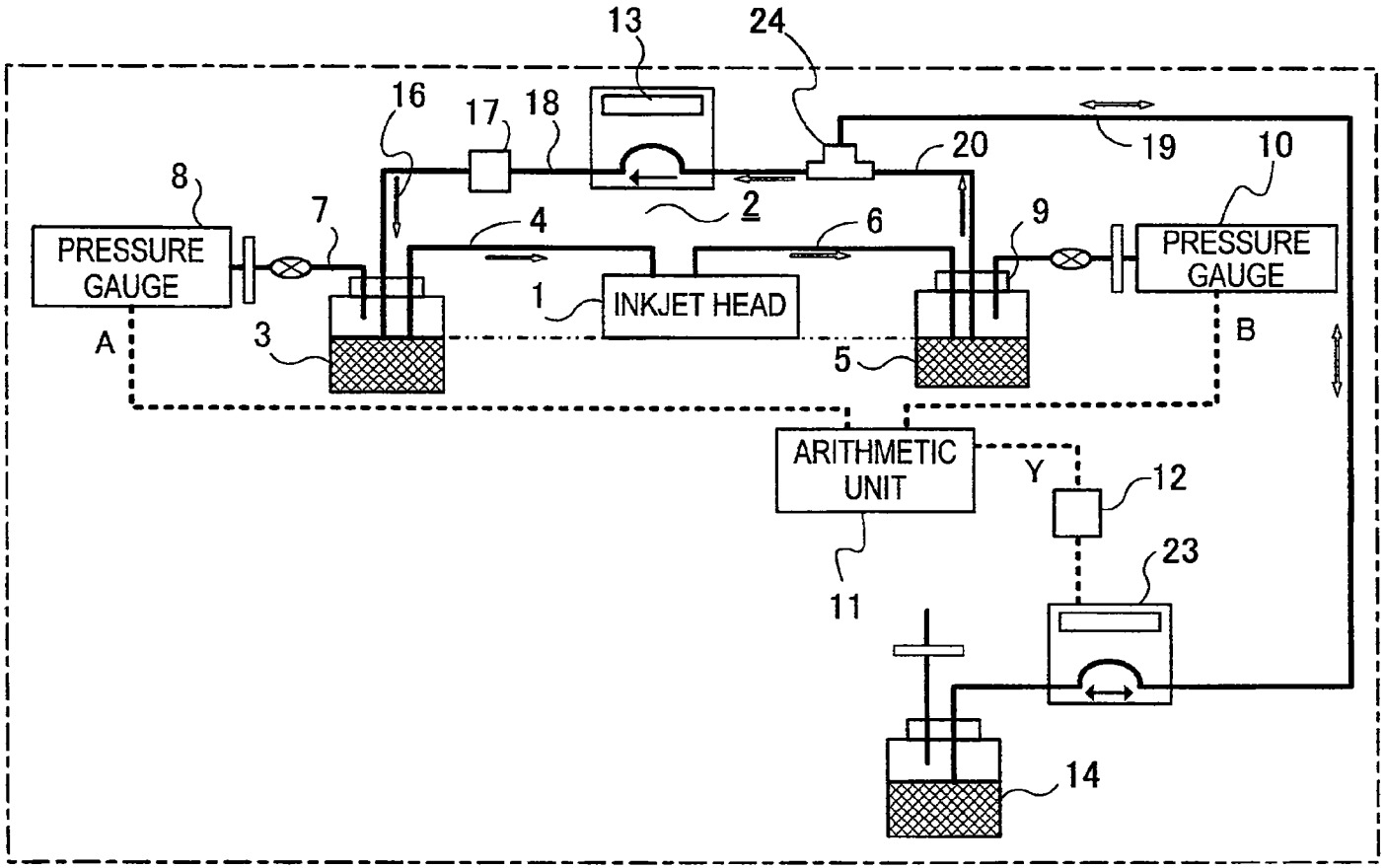
FIG. 1 is a diagram of an inkjet device according to an embodiment of the present invention.

FIG. 1 is a diagram of the configuration of an inkjet device including an inkjet head 1 in an embodiment of the invention. A detailed configuration of the inkjet head 1 is not shown in the figure. However, the inkjet head 1 has the configuration explained in JP-A-2009-202475. The inkjet head 1 includes plural channels (not shown) through which ink is circulated. Thin film-like driving electrodes are respectively provided on inner surfaces of the channels. In a bottom surface portion in the figure, ink discharge ports (hereinafter referred to as nozzles) respectively corresponding to the plural channels are provided. Ink droplets are discharged from the nozzles by applying an electric field to the driving electrodes.

The inkjet head 1 communicates with an upstream side ink tank 3 via a conduit member 4 and communicates with a downstream side ink tank 5 via a conduit member 6. The downstream side ink tank 5 communicates with a suction side of a liquid feeding pump 13 via a conduit member 20. A discharge side of the liquid feeding pump 13 communicates with the upstream side ink tank 3 sequentially via a conduit member 18, a filter 17, and a conduit member 16. These ink circulating devices communicating with one another communicate with the channels of the inkjet head 1. The ink circulating devices and the channels form an ink circulating system 2.

Branching pipes 24 are disposed halfway in the conduit member 20 included in the ink circulating system 2. One of the branching pipes 24 communicates with a conduit member 19. A liquid feeding pump 23 is disposed halfway in the conduit member 19. The conduit member 19 communicates with a supply ink tank 14 via the liquid feeding pump 23. The supply ink tank 14 supplies ink to the upstream side ink tank 3 and the downstream side ink tank 5. The liquid feeding pump 23 normally rotates to supply ink in the supply ink tank 14 to the ink circulating system 2. The liquid feeding pump 23 reversely rotates to return the ink from the ink circulating system 2 to the supply ink tank 14 and functions to increase a negative pressure value of the ink circulating system 2. Therefore, the liquid feeding pump 23 also functions as negative pressure regulating means for regulating a negative pressure value of the ink circulating system 2.

A pressure gauge 8 is attached to the upstream side ink tank 3 via a conduit member 7 to monitor pressure A in the upstream side ink tank 3. A pressure gauge 10 is also attached to the downstream side ink tank 5 via a conduit member 9 to monitor pressure B in the downstream side ink tank 5. The pressure gauge 8 on the upstream side and the pressure gauge 10 on the downstream side 10 are connected to an arithmetic unit 11. Pressure data A and B respectively monitored by the pressure gauges 8 and 10 are sent to the arithmetic unit 11 and arithmetic processing is executed. The arithmetic unit 11 calculates pressure Y in a nozzle section of the inkjet head 1 according to an arithmetic expression explained later. Therefore, the arithmetic unit 11 functions as an arithmetic unit configured to calculate, on the basis of pressure detected from the ink circulating system 2, the pressure Y in the nozzle section according to the arithmetic expression set in advance.

The arithmetic unit 11 is connected to a comparator 12. Data Y subjected to the arithmetic processing by the arithmetic unit 11 is sent to the comparator 12. The comparator 12 functions as a pressure determining device configured to determine whether a value Y calculated by the arithmetic unit 11 is positive pressure or negative pressure with respect to a reference value set in advance. A determination result of the comparator 12 is output as a normal rotation or reverse rotation command for the liquid feeding pump 13.

The reference value means proper pressure of the nozzles not discharging the ink (hereinafter also referred to as proper nozzle pressure). On the other hand, the value Y calculated by the arithmetic unit 11 is present pressure in the nozzle section calculated on the basis of the pressure detected from the ink circulating system 2.

As one characteristic of this embodiment, the reference value can change to the negative pressure side.

Figure 2:
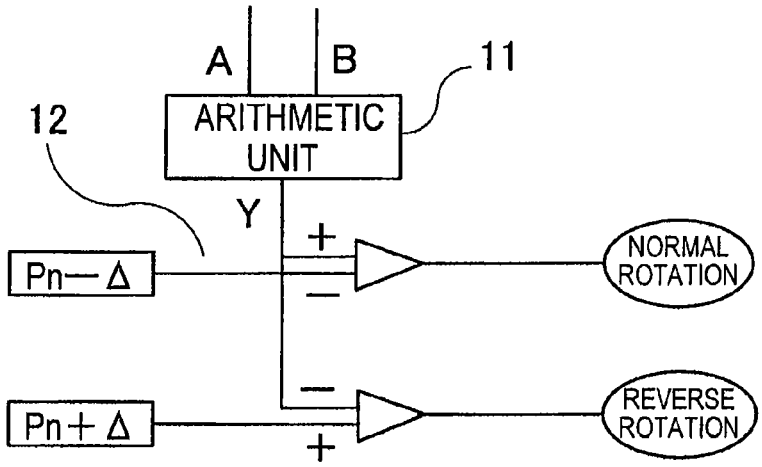
FIG. 2 is a diagram for explaining a determining function of a pressure determining device used in the embodiment of the invention.

A block diagram of the comparator 12 is shown in FIG. 2. If the comparator 12 includes two comparing units as shown in FIG. 2 and the proper nozzle pressure is represented as Pn and hysteresis (explained later) is represented as Δ, the data Y processed by the arithmetic unit 11 is compared with a reference value (Pn+Δ) and a reference value (Pn−Δ). If the data Y is positive pressure with respect to (Pn+Δ), the comparator 12 issues an instruction for reversely rotating the liquid feeding pump 13 to perform an ink reducing operation. Specifically, while the data Y is positive pressure with respect to (Pn+Δ), the comparator 12 reversely rotates the liquid feeding pump 13 to perform the ink reducing operation and operates to increase negative pressure on the nozzles. If the data Y is the same as the proper nozzle pressure Pn (data Y=Pn), the comparator 12 stops the liquid feeding pump 13 and stops the ink reducing operation.

On the other hand, if the data Y is negative pressure with respect to (Pn−Δ), the comparator 12 issues an instruction for normally rotating the liquid feeding pump to perform an operation for supplying the ink. Specifically, while the data Y is more negative pressure than (Pn−Δ) (this means that the ink is dropped from the nozzles), the comparator 12 normally rotates the liquid feeding pump 13 to perform the operation for supplying the ink. If the data Y is the same as the proper nozzle pressure Pn (data Y=Pn), the liquid feeding pump 13 stops to stop the operation for supplying the ink.

In the block diagram of the comparator 12 shown in FIG. 2, Δ (hysteresis) is applied in normally rotating or reversely rotating the liquid feeding pump 13. However, if the liquid feeding pump 13 is normally rotated, the liquid feeding pump 13 is driven at the reference value (Pn−Δ) to be returned to a state before being normally rotated. If the liquid feeding pump 13 is reversely rotated, the liquid feeding pump 13 is driven at the reference value (Pn+Δ) to be returned to a state before being reversely rotated.

In the configuration shown in FIG. 1, if the normal inkjet head 1 does not discharge the ink, if upstream side conduit resistance on the inkjet head 1 is represented as RU, downstream side conduit resistance on the inkjet head 1 is represented as RL, and a channel resistance ratio RU:RL is 1:r, the proper nozzle pressure Pn is controlled so that a relation between P1 (energy per unit area of an upstream side pressure source) and P2 (energy per unit area of a downstream side pressure source) becomes P1·r/(1+r)+P2/(1+r)=Pn (proper nozzle pressure≈1 kPa). In the embodiment shown in FIG. 1, liquid levels of the upstream side ink tank 3 and the downstream side ink tank 4 are adjusted to the height of a nozzle surface (a bottom surface of the inkjet head shown in the figure). Therefore, P1 and P2 are respectively equal to the pressure A in the upstream side ink tank and the pressure Bin the downstream side ink tank. Even if ambient temperature and a type of ink change and channel resistance changes, pressure near the nozzles does not change.

Therefore, an arithmetic expression in the arithmetic unit 11 is set as follows:

$$\begin{aligned} Y &= A - (RU/(RU+RL)) * (A-B) \\ &= (RL/(RU+RL)) * A) + (RU/(RU+RL)) * B) \\ &= (r/(1+r) * A) + (1/(1+r) * B) \end{aligned}$$

where, RU represents upstream side channel resistance, which is channel resistance from the inlet of the conduit member 4 to a nozzle branch in the head, and RL represents downstream side channel resistance, which is channel resistance from the nozzle branch in the head to the outlet of the conduit member 6.

According to the arithmetic expression, the pressure in the ink nozzle section is calculated as the data Y on the basis of actual pressure A in the upstream side ink tank and actual pressure B in the downstream side ink tank in the ink circulating system 2. The comparator 12 compares the data Y with the reference value Pn and determines whether the data Y is positive pressure or negative pressure with respect to the reference value Pn. The reference value Pn is explained below.

If an inkjet-type printing apparatus (not shown) mounted with the inkjet head 1 is not used for a long period or a printing idle time is long, the reference value (the proper nozzle pressure Pn) of the comparator 12 is changed further to the negative pressure side. As explained above, if the inkjet head 1 does not discharge the ink, the normal reference value is set as Pn=−1 kPa. The reference value is adjusted to pressure at which a meniscus retracts as shown in FIGS. 3A to 3E. For example, the proper nozzle pressure Pn is set to −4 kPa in the comparator 12 as the reference value. If the proper nozzle pressure Pn is set in this way, the data Y maintains a positive pressure state with respect to the reference value until nozzle pressure reaches −4 kPa. Therefore, while the positive pressure state is maintained, the liquid feeding pump 13 continues to reversely rotate and performs the ink reducing operation. The ink is drawn to the downstream side by the ink reducing operation. If the ink is drawn, air bubbles and thickened ink present in nozzle hole are caused to flow as shown in FIGS. 3A to 3E and fed to the downstream side ink tank 5 according to the flow of ink circulation from the inside of the nozzle hole.

Figure 3:
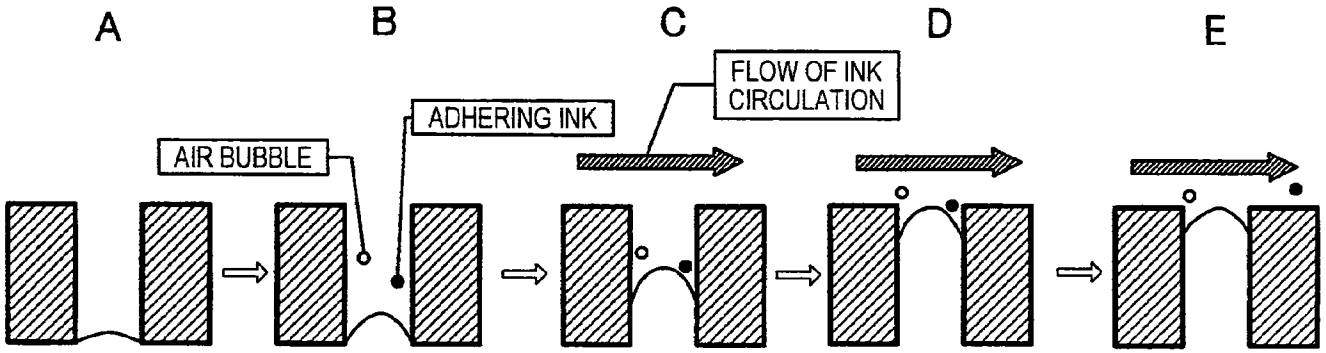
FIGS. 3A to 3E are diagrams for explaining a state in which thickened ink or the like in a nozzle is discharged according to the embodiment of the invention.

FIGS. 3A to 3E are diagrams of behavior of the meniscus in the nozzle hole of the inkjet head 1 during an increase in negative pressure by the ink reducing operation. The meniscus shown in FIG. 3A starts to retract as shown in FIG. 3B. Thereafter, the retraction advances as shown in FIGS. 3C and 3D. If the retraction advances, air bubbles and thickened ink present in the nozzle hole are caused to flow and fed to the downstream side ink tank 5 according to the flow of ink circulation from the inside of the nozzle as shown in FIG. 3E. The thickened ink is diluted in the downstream side ink tank 5 or trapped by the filter 17. Therefore, the thickened ink does not return to the inkjet head 1. Therefore, it is possible to perform printing by returning pressure to the normal proper negative pressure (−1 kPa).

By adopting such a configuration, it is possible to cause air bubbles, thickened ink, and adhering ink present in the nozzle holes to flow and remove the air bubbles, the thickened ink, and the adhering ink from the insides of the nozzle holes. As a result, the insides of the nozzle holes are always wet with fresh ink. It is possible to obtain the inkjet head 1 in which clogging of the nozzle holes due to the thickened ink, non-discharge of the ink, a distortion of a discharge direction, and the like do not occur.

As explained above, if the inkjet-type printing apparatus mounted with the inkjet head is not used for a long period or a printing waiting state lasts long, a negative pressure value is controlled to be negative pressure (−4 kPa) larger than the normal negative pressure value (−1 kPa). This makes it possible to move the meniscuses of the ink in the nozzle holes to thereby surely cause thickened ink adhering to the insides of the nozzle holes to flow and discharge the ink to the downstream side according to ink circulation. Therefore, the insides of the nozzle holes are always wet with ink. Clogging of the nozzle holes due to the thickened ink, non-discharge of the ink, a distortion a discharge direction, and the like do not occur.

In determining that the inkjet-type printing apparatus is not used for a long period or the printing waiting state lasts long, for example, time during which the ink is not discharged from the discharge ports only has to be measured by a timer or the like. If the time during which the ink is not discharged exceeds a planned value, a reference value of the pressure determining device only has to be changed to the negative pressure side.

While certain embodiments have been described, these embodiments have been presented by way of example only, and are not intended to limit the scope of the inventions. Indeed, the novel methods and systems described herein may be embodied in a variety of the other forms; furthermore, various omissions, substitutions and changes in the form of the methods and systems described herein may be made without departing from the spirit of the inventions. The accompanying claims and their equivalents are intended to cover such forms or modifications as would fall within the scope and spirit of the inventions.

What is claimed is:

1. An inkjet device including an inkjet head provided with a driving electrode in a channel for circulating ink and configured to apply an electric field to the driving electrode to thereby discharge the ink from an ink discharge port, the device comprising:

an ink circulating device configured to communicate with the inkjet head to form an ink circulating system;

an arithmetic unit configured to calculate, on the basis of pressure detected from the ink circulating system, pressure in a section of the ink discharge port according to an arithmetic expression set in advance;

a pressure determining unit configured to determine, with proper nozzle pressure in the ink discharge port not discharging ink set as a reference value, whether a value calculated by the arithmetic unit is positive pressure or negative pressure with respect to the reference value, and to be able to change the reference value to a negative pressure side; and a negative pressure regulator configured to communicate with the ink circulating system and perform, if the pressure determining unit determines that the value is the positive pressure, an ink reducing operation in the ink circulating system and increase a negative pressure value on the ink discharge port.

2. The device according to claim 1, wherein, if the proper nozzle pressure as the reference value is represented as Pn, upstream side conduit resistance as conduit resistance from an inlet of a conduit member to a nozzle branch in the head is represented as RU, downstream side conduit resistance as conduit resistance from the nozzle branch in the head to an outlet of the conduit member is represented as RL, and a channel resistance ratio RU:RL is 1:r, a relation between P1 (energy per unit area of an upstream side pressure source) and P2 (energy per unit area of a downstream side pressure source) is set to be $P1 \cdot r/(1+r)+P2/(1+r)=Pn$.

3. The device according to claim 2, wherein, in the ink circulating system, ink tanks are respectively provided on an upstream side and a downstream side with respect to the inkjet head, and the pressure to be detected is pressure in the upstream side ink tank and pressure in the downstream side ink tank.

4. The device according to claim 3, wherein, if the pressure in the ink discharge port section is represented as Y, the pressure in the upstream side ink tank is represented as A, and the pressure in the downstream side ink tank is represented as B, the arithmetic expression is represented as $Y=(r/1+r)*A)+(r/(1+r)*B)$.

5. The device according to claim 4, wherein liquid levels of the upstream side ink tank and the downstream side ink tank are adjusted to height of a nozzle surface of the inkjet head.

6. The device according to claim 3, wherein pressure gauges for detecting internal pressure are respectively provided in the upstream side ink tank and the downstream side ink tank.

7. The device according to claim 3, further comprising a supply tank for supplying the ink to the upstream side ink tank and the downstream side ink tank, wherein the negative pressure regulator is a liquid feeding pump configured to operate to normally rotate or reversely rotate according to a determination result by the pressure determining unit, and if the determination result by the pressure determining unit is positive pressure with respect to the reference value, the negative pressure regulator operates to reversely rotate and returns the ink from the ink circulating system to the supply tank to reduce an amount of the ink and increase a negative pressure value of the ink circulating system.

8. The device according to claim 7, wherein, if the determination result by the pressure determining unit is negative pressure with respect to the reference value, the liquid feeding pump operates to normally rotate to supply the ink in the supply tank to the ink circulating system.

9. The device according to claim 7, wherein energy per unit area of the upstream side pressure source and pressure in the upstream side ink tank are equal, and energy per unit area of the downstream side pressure source and pressure in the downstream side ink tank are equal.

10. The device according to claim 7, where, when the liquid feeding pump is driven, if the liquid feeding pump is normally rotated taking into account Δ (hysteresis), the liquid feeding pump is driven to normally rotate at the reference value=(Pn−Δ) and, if the liquid feeding pump is reversely rotated, the liquid feeding pump is driven to reversely rotate at the reference value=(Pn+Δ).

11. The device according to claim 7, wherein, if an inkjet-type printing apparatus mounted with the inkjet head is not used for a long period or a printing idle time is long, the reference value in the pressure determining device is set on the negative pressure side to be a negative pressure value larger than a normal negative pressure value.

12. The device according to claim 1, wherein the pressure determining unit changes the reference value to the negative pressure side if time during which the ink is not discharged from the discharge port exceeds a planned value.

13. An inkjet device including an inkjet head provided with a driving electrode in a channel for circulating ink and configured to apply an electric field to the driving electrode to thereby discharge the ink from an ink discharge port, the device comprising:

an ink circulating device configured to communicate with the inkjet head to form an ink circulating system, and to include ink tanks respectively provided on an upstream side and a downstream side with respect to the inkjet head, and pressure gauges for detecting internal pressure which are respectively provided in the upstream side ink tank and the downstream side ink tank;

an arithmetic unit configured to receive input of measurement values from the pressure gauges on the upstream side and the downstream side and calculate pressure in the ink discharge port section from the measurement values, a channel resistance value from the upstream side ink tank to the inkjet head set in advance, and a channel resistance value from the inkjet head to the downstream side ink tank;

a pressure determining unit configured to determine, with proper nozzle pressure in the ink discharge port not discharging ink set as a reference value, whether a value calculated by the arithmetic unit is positive pressure or negative pressure with respect to the reference value, and to be able to change the reference value to a negative pressure side; and a negative pressure regulator configured to communicate with the ink circulating system and perform, if the pressure determining unit determines that the value is the positive pressure, an ink reducing operation in the ink circulating system and increase a negative pressure value on the ink discharge port.

14. The device according to claim 13, wherein the pressure determining unit changes the reference value to the negative pressure side if time during which the ink is not discharged from the discharge port exceeds a planned value.

15. The device according to claim 13, further comprising a supply tank for supplying the ink to the upstream side ink tank and the downstream side ink tank, wherein the negative pressure regulator is a liquid feeding pump configured to operate to normally rotate or reversely rotate according to a determination result by the pressure determining unit, and if the determination result by the pressure determining unit is positive pressure with respect to the reference value, the negative pressure regulator operates to reversely rotate and returns the ink from the ink circulating system to the supply tank to reduce an amount of the ink and increase a negative pressure value of the ink circulating system.

16. The device according to claim 15, wherein, if the determination result by the pressure determining unit is negative pressure with respect to the reference value, the liquid feeding pump operates to normally rotate to supply the ink in the supply tank to the ink circulating system.

17. The device according to claim 15, where, if the proper nozzle pressure is represented as PN, when the liquid feeding pump is driven, if the liquid feeding pump is normally rotated taking into account Δ (hysteresis), the liquid feeding pump is driven to normally rotate at the reference value=(Pn−Δ) and, if the liquid feeding pump is reversely rotated, the liquid feeding pump is driven to reversely rotate at the reference value=(Pn+Δ).

18. The device according to claim 15, wherein, if an inkjet-type printing apparatus mounted with the inkjet head is not used for a long period or a printing idle time is long, the reference value in the pressure determining device is set on the negative pressure side to be a negative pressure value larger than a normal negative pressure value.

19. The device according to claim 13, wherein liquid levels of the upstream side ink tank and the downstream side ink tank are adjusted to height of a nozzle surface of the inkjet head.

20. A method of controlling an inkjet head in an inkjet device including an inkjet head provided with a driving electrode in a channel for circulating ink and configured to apply an electric field to the driving electrode to thereby discharge the ink from an ink discharge port, the method comprising:

calculating, on the basis of pressure detected from an ink circulating system configured to communicate with the inkjet head, pressure in a section of the ink discharge port according to an arithmetic expression set in advance;

setting, as a reference value, proper nozzle pressure in the ink discharge port not discharging ink;

determining whether a pressure value in the ink discharge port section is positive pressure or negative pressure with respect to the reference value; and performing, if a negative pressure regulator configured to communicate with the ink circulating system determines that the pressure value is the positive pressure according to a result of the determination, an ink reducing operation in the ink circulating system and increasing a negative pressure value on the ink discharge port.

* * * * *